US006957862B2

(12) United States Patent
Chen

(10) Patent No.: US 6,957,862 B2
(45) Date of Patent: Oct. 25, 2005

(54) CHAIR WITH A SEAT-INCLINATION ADJUSTING DEVICE

(76) Inventor: Su-Ming Chen, No. 566, Fong-Lin 2nd Rd., Ta-Liao, Hsiang, Kaohsiung Hsien (TW)

( * ) Notice: Subject to any disclaimer, the term of this patent is extended or adjusted under 35 U.S.C. 154(b) by 120 days.

(21) Appl. No.: 10/683,256

(22) Filed: Oct. 9, 2003

(65) Prior Publication Data

US 2005/0077766 A1 Apr. 14, 2005

(51) Int. Cl.[7] ..... A47C 1/024; A47C 1/026; A47C 1/038; A47C 3/026

(52) U.S. Cl. ..... 297/300.1; 297/302.1; 297/302.4; 297/316

(58) Field of Search ..... 297/300.1, 302.1, 297/302.4, 316

(56) References Cited

U.S. PATENT DOCUMENTS 5,249,839 A * 10/1993 Faiks et al. ..... 297/300.1
6,033,020 A * 3/2000 Ito ..... 297/302.4
6,250,715 B1 * 6/2001 Caruso et al. ..... 297/302.1 X
6,276,755 B1 * 8/2001 Su ..... 297/302.4 X
6,349,992 B1 * 2/2002 Knoblock et al. ... 297/300.1 X
6,382,723 B1 * 5/2002 Piretti ..... 297/300.1
6,572,191 B2 * 6/2003 Wild ..... 297/301.1 X
6,588,843 B1 * 7/2003 Ebenstein ..... 297/300.1
6,709,056 B2 * 3/2004 Bock ..... 297/300.1 X
6,840,578 B1 * 1/2005 Su ..... 297/300.1 X
2003/0034682 A1 * 2/2003 Stumpf et al. ..... 297/316
2004/0051358 A1 * 3/2004 Bodnar et al. ..... 297/300.1
2004/0095007 A1 * 5/2004 Wilkerson et al. ..... 297/300.1

* cited by examiner

*Primary Examiner*—Rodney B. White
(74) *Attorney, Agent, or Firm*—Ostrolenk, Faber, Gerb & Soffen, LLP

(57) ABSTRACT

A chair includes an upper frame disposed above and pivoted to a lower frame. An inclination adjusting device includes a latch mounted slidably on the upper frame and movable between a first position, in which the latch extends into and engages a selected one of engaging grooves in a latch engaging member that is formed on the lower frame, and a second position, in which the latch disengages the selected engaging groove.

7 Claims, 8 Drawing Sheets

CHAIR WITH A SEAT-INCLINATION ADJUSTING DEVICE

BACKGROUND OF THE INVENTION

1. Field of the Invention

The present invention relates to a chair, more particularly to a chair with a seat-inclination adjusting device for preventing tilting of a seat relative to a leg unit.

2. Description of the Related Art

Referring to FIGS. 1 and 2, a conventional chair 1 is shown to include a leg unit 11, a base frame 13, a top frame 14, a seat 120, a backrest-supporting frame 15, and a positioning unit 2.

As illustrated, the base frame 13 has opposite front and rear ends, a bottom plate 132 mounted securely on the leg unit 11, and two side plates 131 extending upwardly from two opposite sides of the bottom plate 132. The top frame 14 is disposed above the base frame 13, and includes a seat-supporting plate 142, and two side plates 141 that extend downwardly from two opposite sides of the seat-supporting plate 142 and that are pivoted respectively to the side plates 131 of the base frame 13 through a first pivot 16 so as to permit pivotal action of the top frame 14 relative to the base frame 13. The seat 120 is mounted on the seat-supporting plate 142 of the top frame 14. An urging mechanism 19 is mounted on the base frame 13, and urges the front end of the bottom plate 132 toward the top frame 14.

The backrest-supporting frame 15 is disposed rearwardly of the base frame 13, and includes two side plates 151 pivoted respectively to the side plates 131 of the base frame 13 through a second pivot 18, and to two lugs 143 formed on the side plates 141 of the top frame 14 through a third pivot 17 such that the second and third pivots 18, 17 are disposed rearwardly of and are parallel to the first pivot 16. A backrest 10 is mounted on the backrest-supporting frame 15.

The positioning unit 2 includes a control rod 22 and a stopping member 21 that has a tubular portion 212 defining a retention hole 213 and an annular flange 211 extending radially and outwardly from the tubular portion 212 and welded to an inner wall of the side plate 141 of the top frame 14. The control rod 22 extends slidably through a pair of holes 133 formed respectively in the side plates 131 of the base frame 13, and is movable between a locking position, in which an engaging end 223 of the control rod 22 engages the retention hole 213 in the stopping member 21 so as to prevent the top frame 14 from tilting relative to the base frame 13, and a releasing position, in which the engaging end 223 of the control rod 22 disengages the stopping member 21 so as to permit tilting of the top frame 14 relative to the base frame 13.

Disadvantages of the conventional chair reside in that welding of the stopping member 21 to the inner wall of said one of the side plates 141 of the top frame 14 is difficult to conduct, and that alignment of the control rod 22 with the retention hole 213 is not easy. Moreover, since the diameter of the holes 133 is required to be approximate to that of the control rod 22, operation of the control rod 22 to extend the engaging end 223 into the retention hole 213 is not smooth. Besides, the engaging end 223 of the control rod 22 tends to deform after a period of use.

SUMMARY OF THE INVENTION

Therefore, the object of this invention is to provide a chair with a seat-inclination adjusting device so as to overcome the aforesaid disadvantages of the prior art.

According to the present invention, a chair includes: a leg unit; a lower frame having opposite front and rear ends, a base plate secured to the leg unit, spaced-apart side plates extending between the front and rear ends in a longitudinal direction, and a latch engaging member that extends upwardly from the base plate and that is formed with a plurality of spaced apart engaging grooves aligned in a first transverse direction relative the longitudinal direction and the base plate; a first pivot extending in a second transverse direction relative to the first transverse direction and the longitudinal direction; an upper frame including a seat-mounting plate disposed above the lower frame, and two side plates that extend downwardly and respectively from two opposite sides of the seat-mounting plate and that are respectively pivoted to the side plates of the lower frame through the first pivot as to permit pivotal action of the upper frame relative to the lower frame; an urging mechanism connected to the seat-mounting plate of the upper frame and the front end of the lower frame so as to resiliently hold the seat-mounting plate in position; and an inclination adjusting device. The inclination adjusting device includes a latch mounted slidably on the seat-mounting plate of the upper frame, disposed rearwardly of the latch engaging member, and movable in the longitudinal direction between a first position, in which the latch extends into and engages a selected one of the engaging grooves in the latch engaging member, and a second position, in which the latch disengages the selected one of the engaging grooves in the latch engaging member. An urging member urges the latch so as to restore the latch from the first position to the second position.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
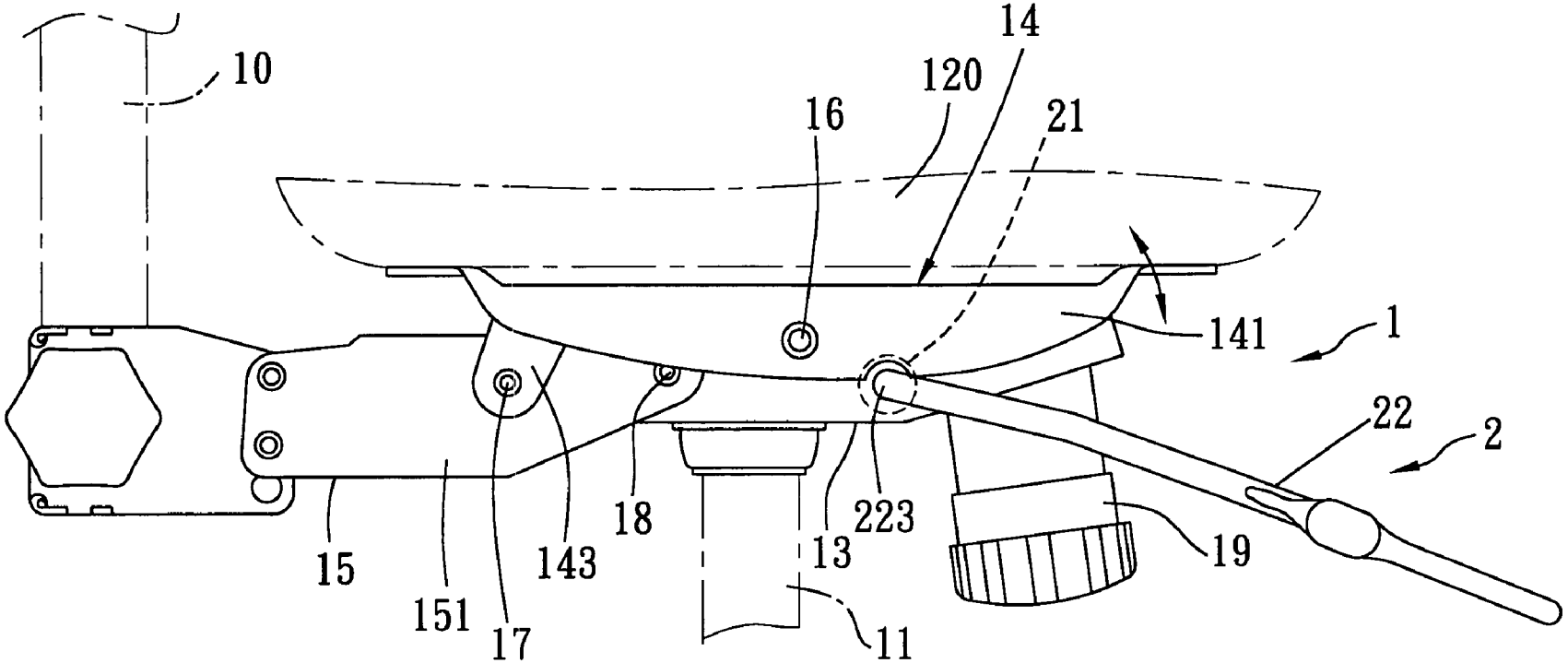
FIG. 1 PRIOR ART
FIG. 1 is a schematic fragmentary side view of a conventional chair.
Figure 2:
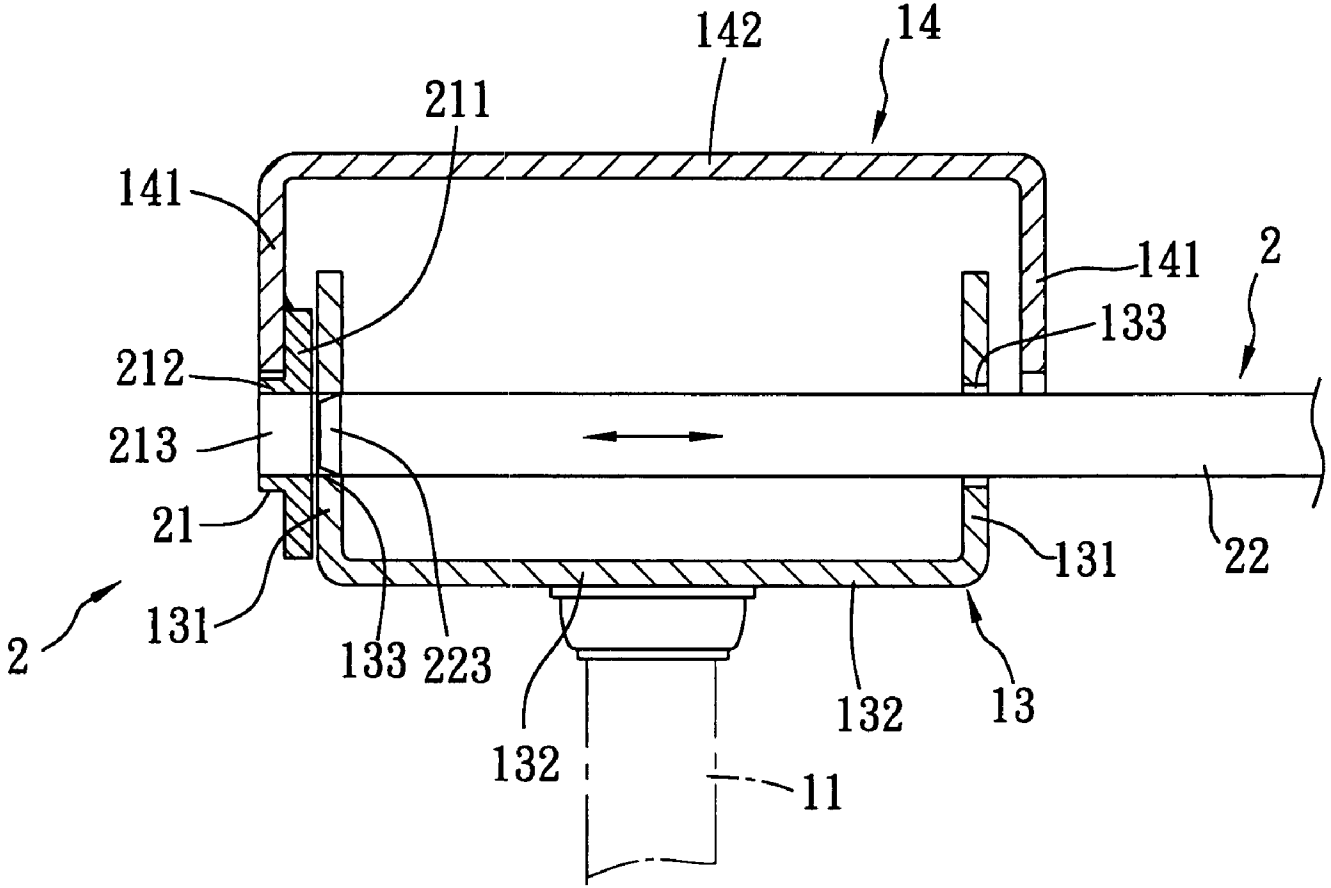
FIG. 2 PRIOR ART
FIG. 2 is a fragmentary sectional view of the conventional chair, illustrating a top frame which is pivotable relative to a base frame.
Figure 3:
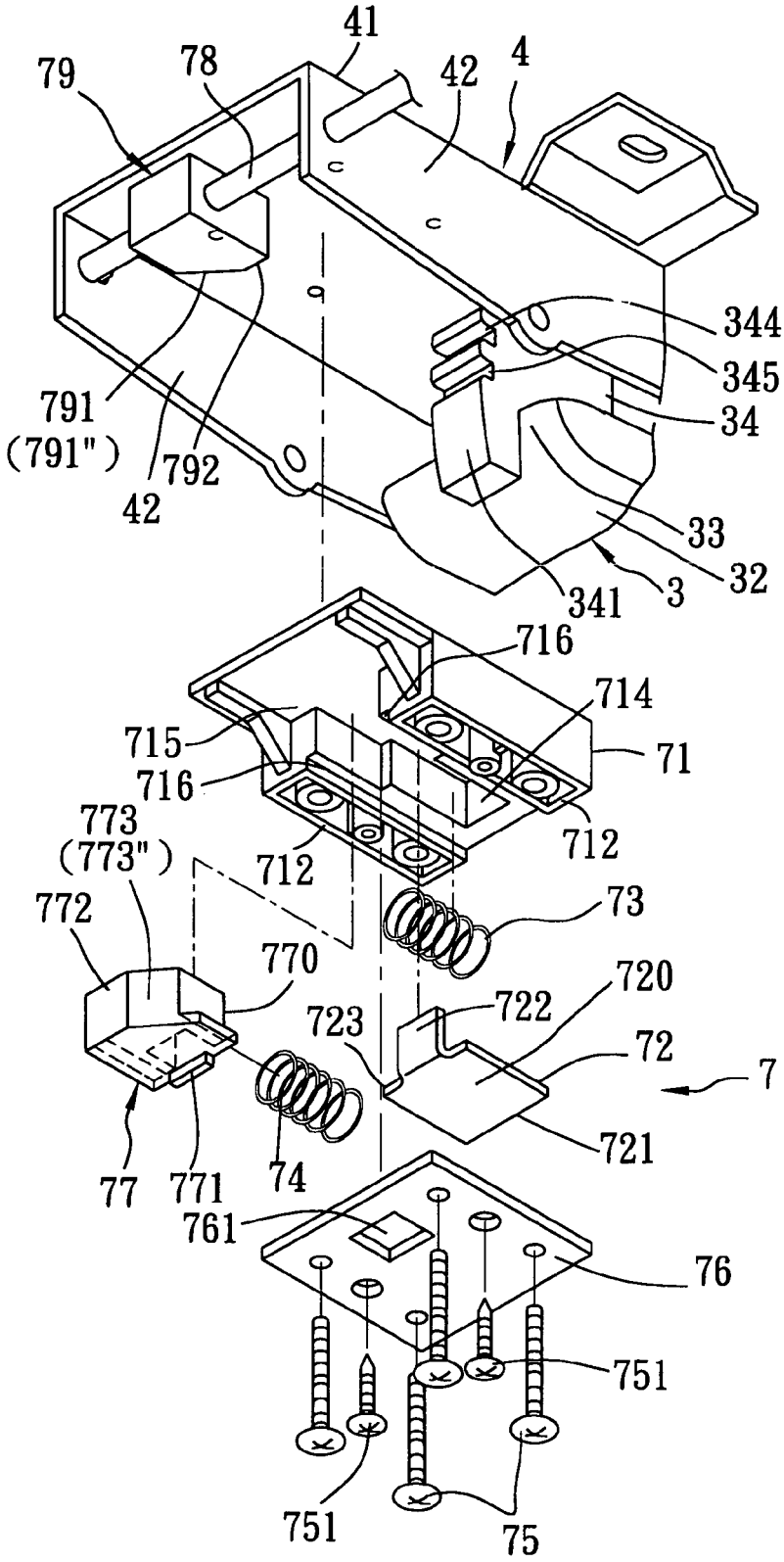
FIG. 3 is a fragmentary exploded perspective view and an upper frame of the preferred embodiment of a chair according to the present invention.

Referring to FIGS. 3 to 6, the preferred embodiment of a chair according to the present invention is shown to include a leg unit 110, a U-shaped lower frame 3, a first pivot 61, an inverted U-shaped upper frame 4, a seat member 12, an urging mechanism 62, and an inclination adjusting device 7.

The leg unit 110 can include a hydraulically or pneumatically operated cylinder device.

The lower frame 3 has opposite front and rear ends 311,33, and includes a base plate 32 secured to a top end of the leg unit 110, spaced-apart side plates 31 extending between the front and rear ends 311,33 in a longitudinal direction, and a latch engaging member 34 that extends upwardly from the rear end 33 of the base plate 32 and that has a rear face 341 formed with a plurality of spaced-apart engaging grooves (343,344,345) aligned in a first transverse direction relative to the longitudinal direction and the base plate 32.

The first pivot 61 extends in a second transverse direction relative to the longitudinal direction and the first transverse direction.

The upper frame 4 includes a seat-mounting plate 41 disposed above the side plates 31 of the lower frame 3, and two side plates 42 that extend downwardly and respectively from two opposite sides of the seat-mounting plate 41 and that are pivoted respectively to the side plates 31 of the lower frame 3 through the first pivot 61 so as to permit pivotal action of the upper frame 4 relative to the lower frame 3. The seat member 12 is mounted on the seat-mounting plate 41 of the upper frame 4 to permit sitting of a person thereon.

The urging mechanism 62 (see FIG. 6) is mounted on the lower frame 3, and is connected to a front end 411 of the seat-mounting plate 41 so as to resiliently hold the front end 411 of the seat-mounting plate 41 in position.

Figure 7:
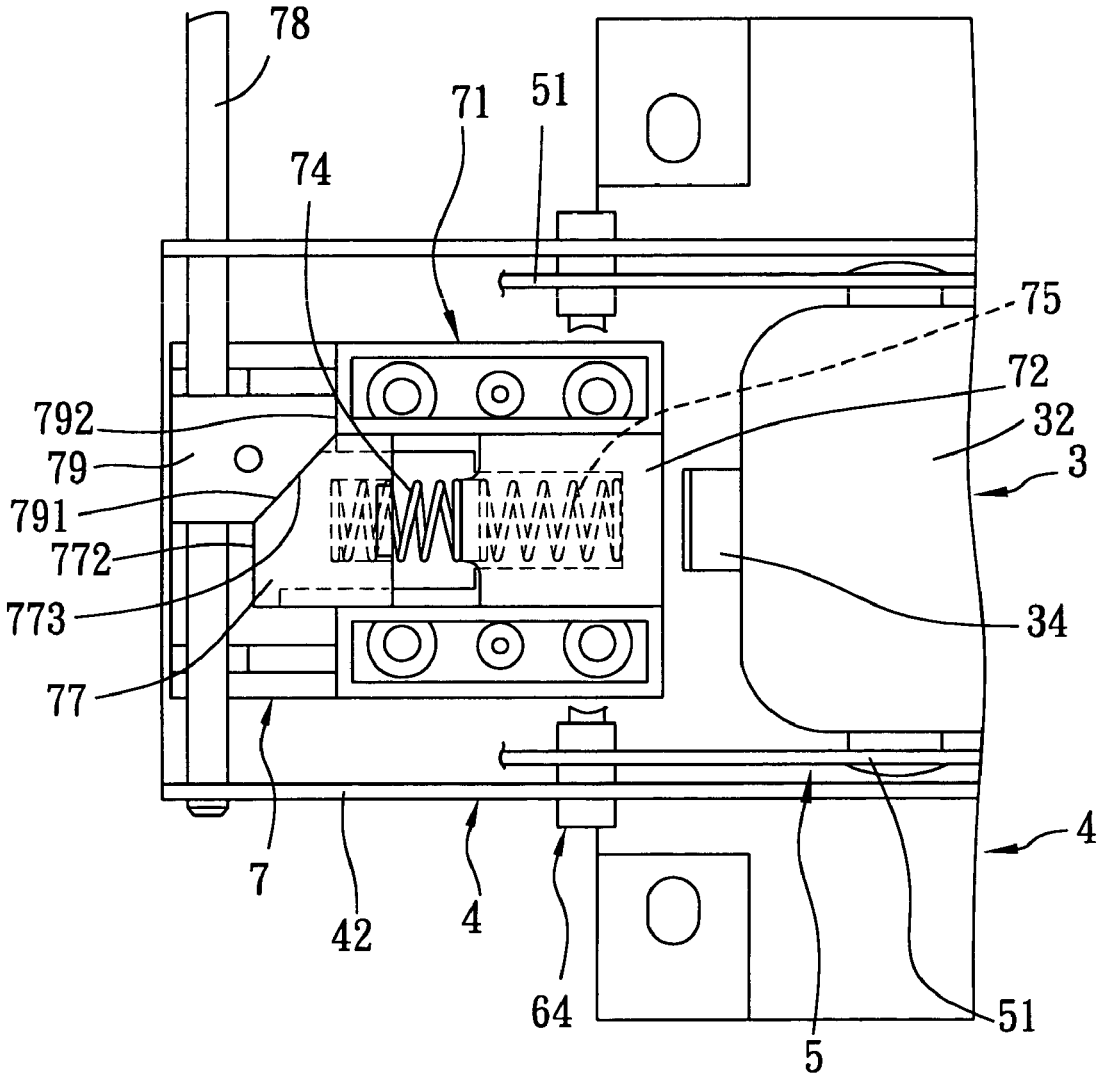
FIG. 7 is a fragmentary sectional bottom view of the preferred embodiment, illustrating that the latch is in the second position where the latch disengages the selected groove.

The inclination adjusting device 7 includes a latch 72, a retaining box 71, an urging member 73, a cam mechanism, and an operating lever 78. The latch 72 is mounted slidably on the seat-mounting plate 41 of the upper frame 4, is disposed rearwardly of the latch engaging member 34, and is movable in the longitudinal direction between a first position, in which the latch 72 extends into and engages a selected one of the engaging grooves (343,344,345) in the latch engaging member 34 (see FIGS. 4 and 5), and a second position, in which the latch 72 disengages the selected one of the engaging grooves (343,344,345) in the latch engaging member 34 (see FIGS. 6 and 7).

The retaining box 71 is fixed to a bottom side of the seat-mounting plate 41, is disposed rearwardly of the latch engaging member 34, and has a bottom side 712 formed with a pair of guiding grooves 716 extending in the longitudinal direction. The retaining box 71 is formed with a front receiving chamber 714 that is disposed above and that is in spatial communication with the guiding grooves 716, and a rear receiving chamber 715 that is enlarged from the front receiving chamber 714, and that is disposed rearwardly of and that is in spatial communication with the front receiving chamber 714. The latch 72 preferably includes a latch plate 720 that engages slidably the guiding grooves 716 and that has a front engaging end 721 and a rear coupling end 723 opposite to the front engaging end 721, and an abutment plate 722 projecting upwardly from the rear coupling end 723 of the latch plate 720 in the first transverse direction into the front receiving chamber 714 in the retaining box 71. The urging member 73 is preferably a restoration spring, and is disposed within the front receiving chamber 714 in such a manner as to urge constantly the abutment plate 722 of the latch 72 so as to position the latch 72 at the second position. When the latch plate 720 is moved along the guiding grooves 716 from the second position to the first position, the front engaging end 721 of the latch plate 720 projects outwardly from the guiding grooves 716 to engage the selected one of the engaging grooves 343 in the latch engaging member 34.

The cam mechanism includes a cam 79 and a cam follower 77. The cam 79 is disposed movably within the rear guiding chamber 715 in the retaining box 71, and is formed with a first inclined face 791 defining a first cam face 791". The cam follower 77 is mounted movably within the front receiving chamber 714, and is disposed rearwardly of and is associated with the abutment plate 722 of the latch 72 in such a manner as to simultaneously move therewith. The cam follower 77 is formed with a second inclined face 773 defining a second cam face 773" in sliding contact with the first cam face 791" of the cam 79 by virtue of urging action of the urging member 73. The cam 79 is movable in the rear receiving chamber 715 between a restricting position and a releasing position in such a manner that movement of the cam 79 from the releasing position to the restricting position results in movement of the latch 72 with the cam follower 77 to the first groove engaging position and that movement of the cam 79 from the restricting position to the releasing position results in movement of the latch 72 with the cam follower 77 to the second groove disengaging position.

In this embodiment, the operating lever 78 is mounted on the upper frame 4, and extends movably in the second transverse direction through the rear receiving chamber 715 in the retaining box 71, and through the side plates 42 of the upper frame 4. The cam 79 is in the form of a block that is mounted securely on the operating lever 78 for co-movement therewith. The first and second cam faces 791",773" are inclined relative to the operating lever 78. The cam 79 is further formed with a front abutment face 792 that is parallel to the operating lever 78 and that extends from the first cam face 791". The cam follower 77 is further formed with a rear abutment face 772 that is parallel to the operating lever 78 and that extends from the second cam face 773". The cam 79 is further movable within the rear receiving chamber 715 by virtue of sliding movement of the operating lever 78 from the restricting position to a stopping position, in which the front abutment face 792 of the cam 79 abuts against the rear abutment face 772 of the cam follower 77 (see FIG. 5), thereby preventing sliding movement of the cam 79 from the stopping position to the releasing position.

The cam follower 77 has a front end 770 opposite to the rear abutment face 772, and is further formed with an engaging tongue 771 projecting downwardly therefrom adjacent to the front end 770. A bottom plate 76 is secured to the bottom side 712 of the retaining box 71 through a plurality of screws 75,751 so as to conceal the guiding grooves 716, thereby preventing downward removal of the urging member 73 and the latch 72 from the front receiving chamber 714. The bottom plate 76 is formed with a through-hole 761 to permit extension of the engaging tongue 771 of the cam follower 77 therethrough so as to prevent removal of the cam follower 77 from the front receiving chamber 714 in the retaining box 71.

A backrest-supporting frame 5 is disposed rearwardly of the lower frame 3, and includes a bottom plate 52 and two side plates 51 extending in the longitudinal direction. The side plates 51 of the backrest-supporting frame 5 are pivoted respectively to the side plates 31 of the lower frame 3 through a second pivot 63 and to the side plates 42 of the upper frame 4 through a third pivot 64 such that the second and third pivots 63, 64 are disposed rearwardly of and are parallel to the first pivot 61. A backrest (not shown) can be mounted on the bottom plate 52 of the backrest-supporting frame 5. A compression spring 74 is disposed between and abuts against the cam follower 77 and the abutment plate 722 of the latch 72.

Figure 4:
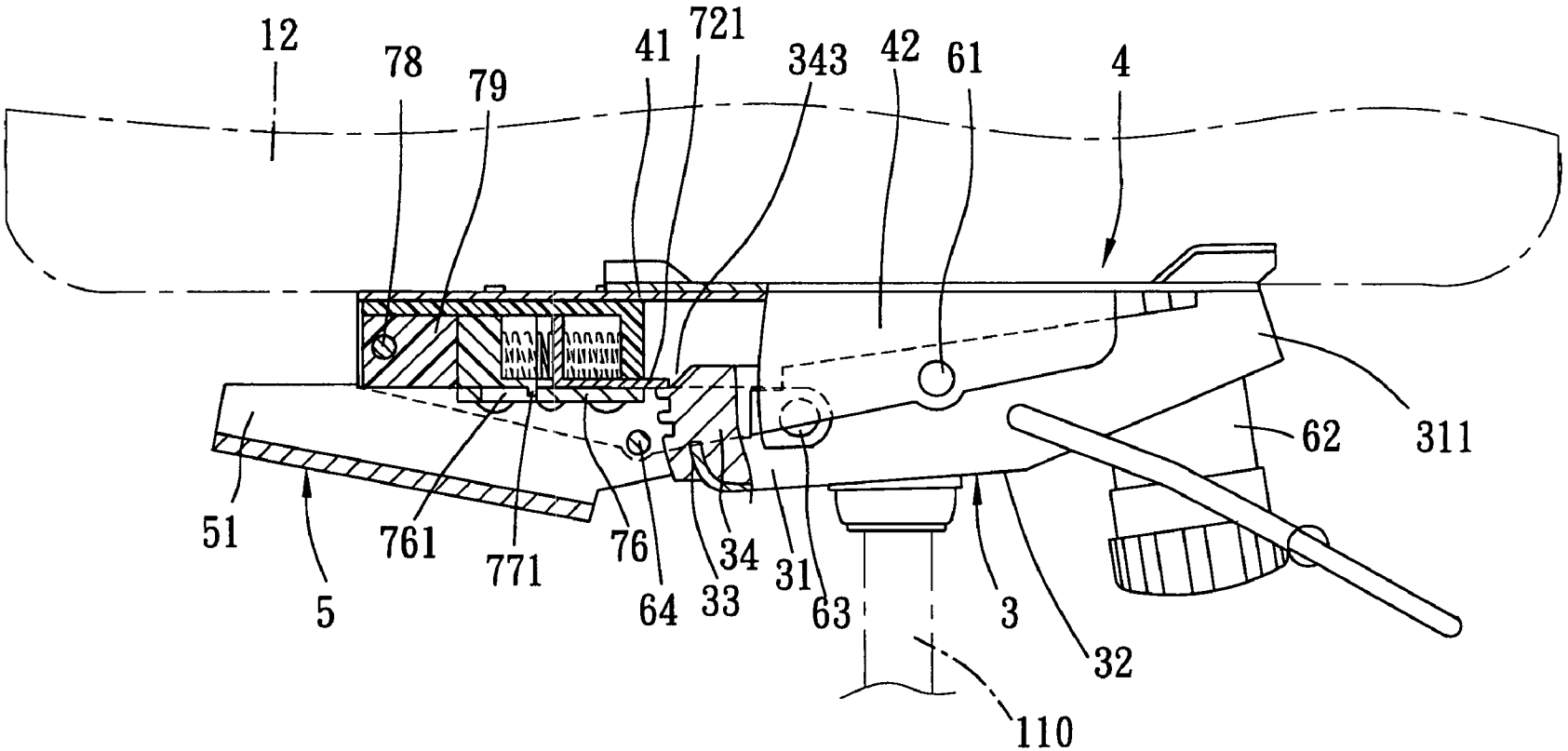
FIG. 4 is a fragmentary sectional side view of the preferred embodiment, illustrating that a latch is in a first position to engage a selected groove.
Figure 5:
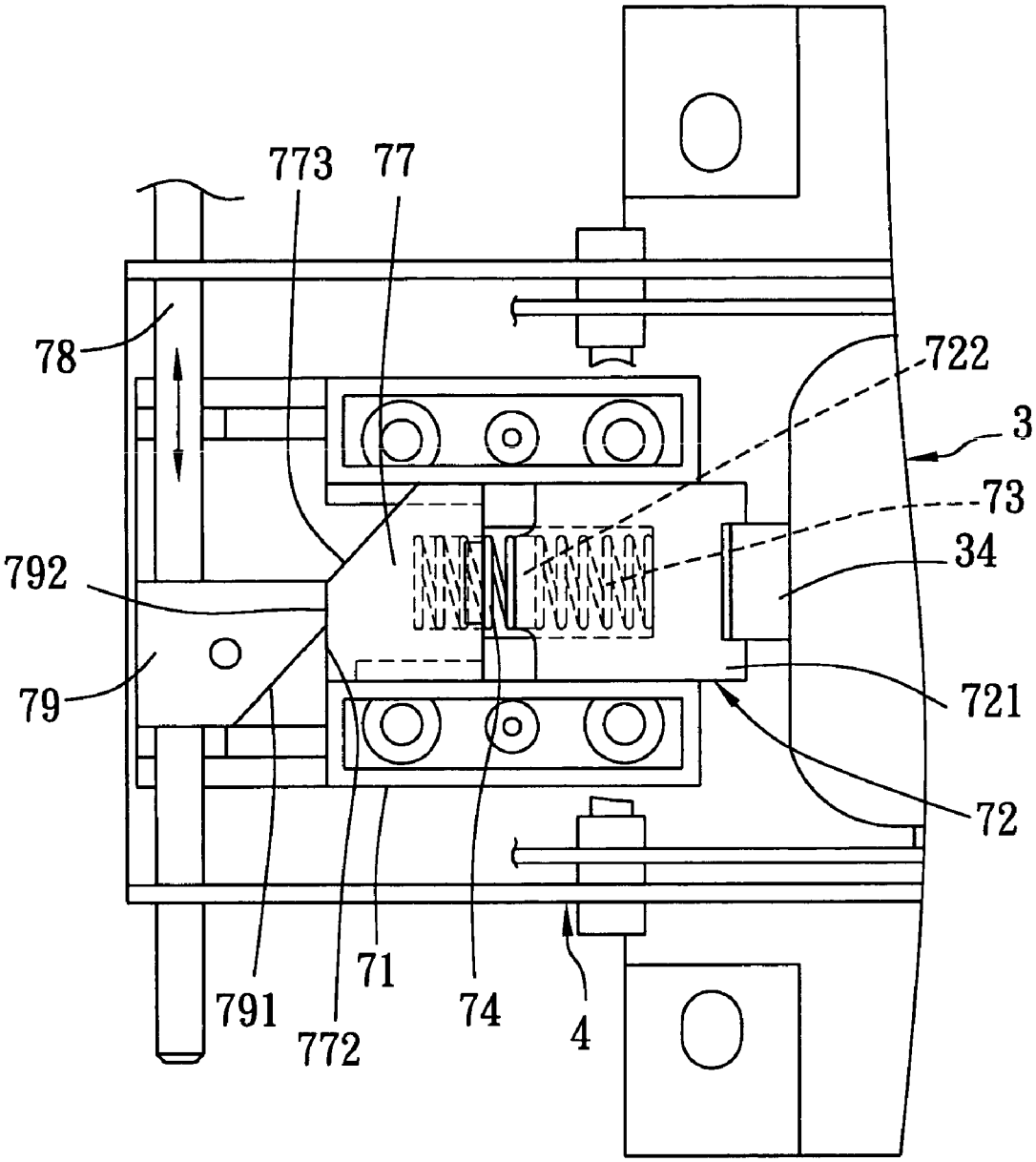
FIG. 5 is a fragmentary sectional bottom view of the preferred embodiment, illustrating that the latch is in the first position to engage the selected groove.
Figure 6:
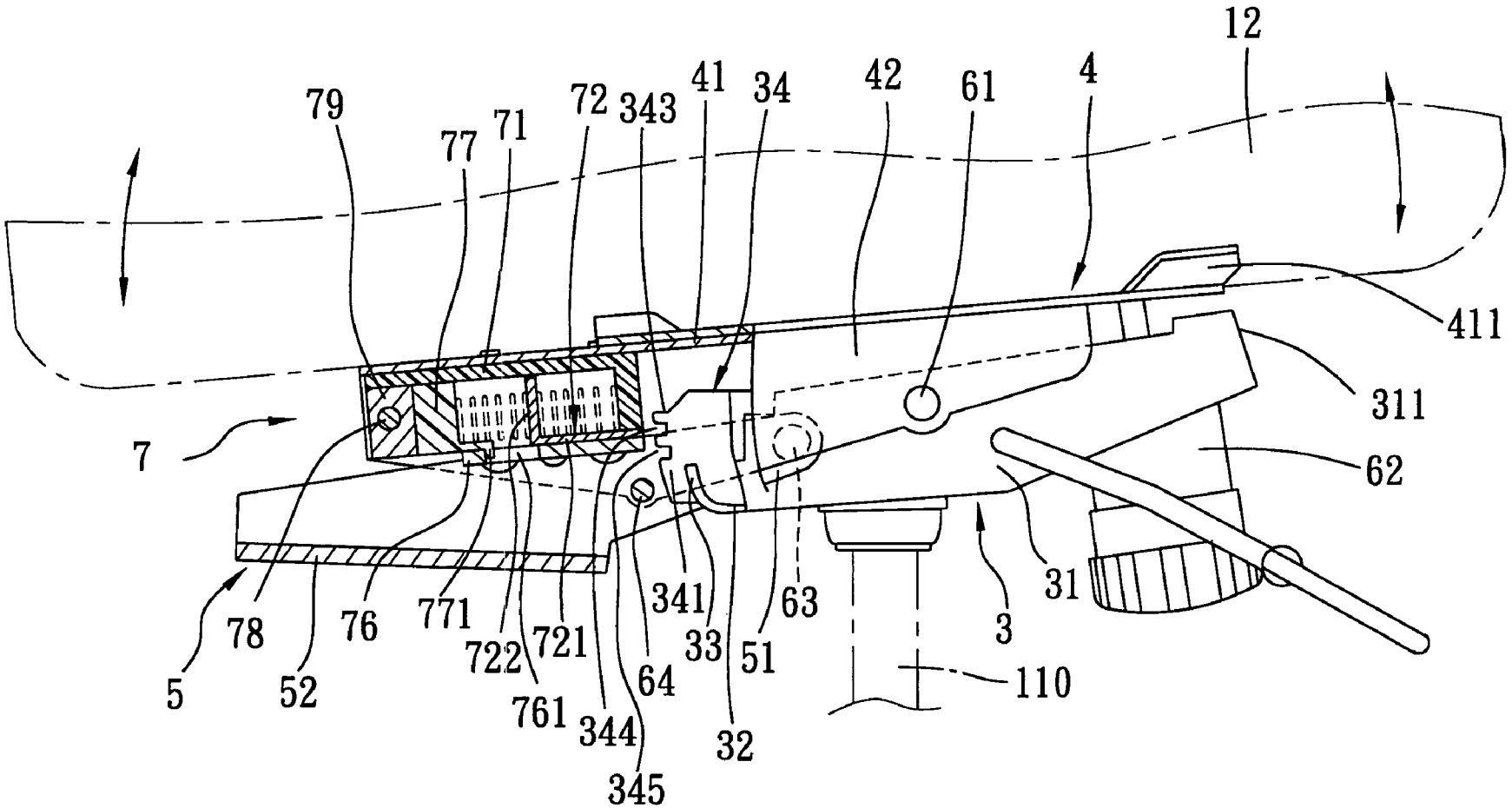
FIG. 6 is a schematic fragmentary side view of the preferred embodiment, illustrating that the latch is in a second position where the latch disengages the selected groove.
Figure 8:
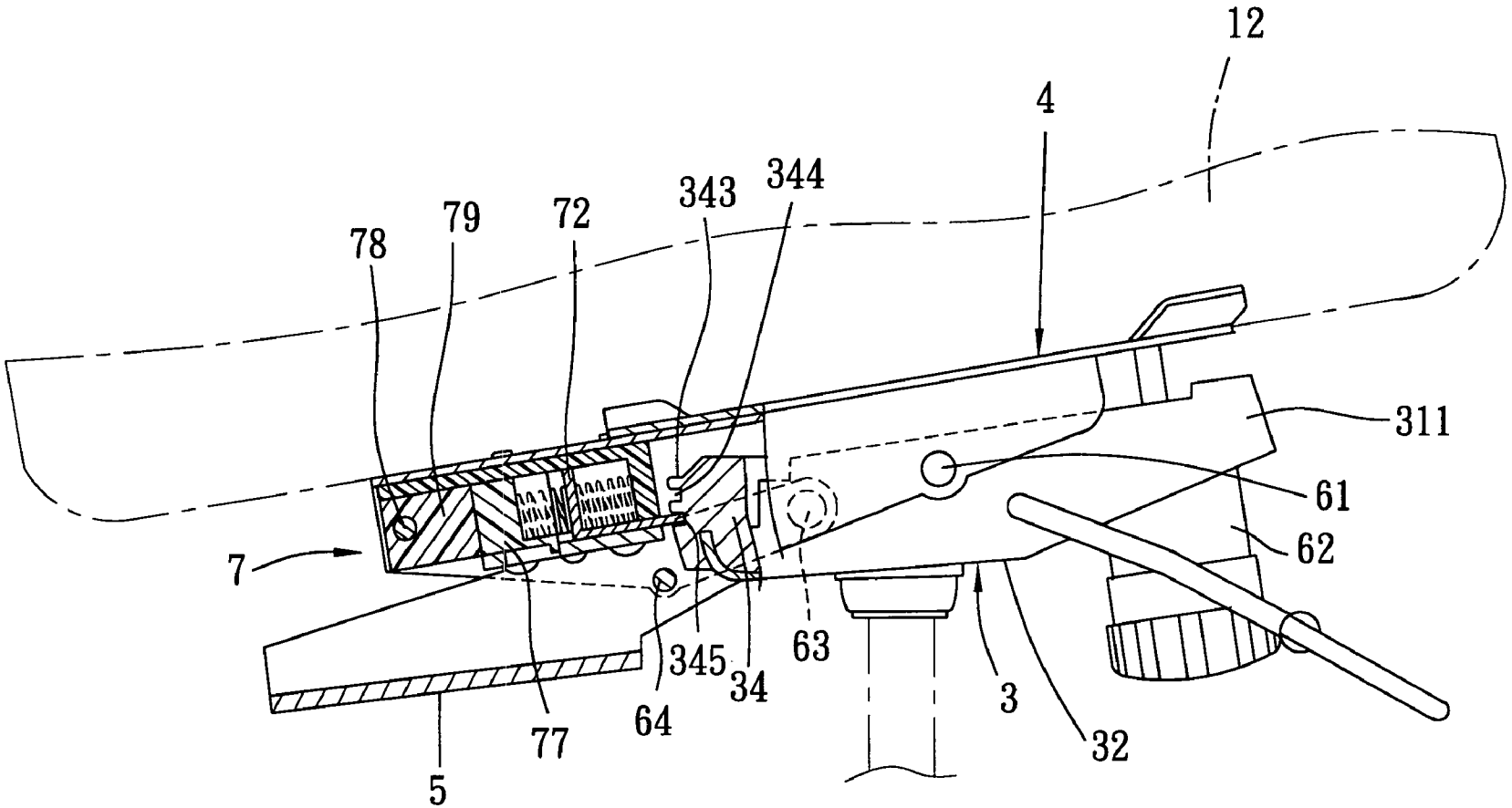
FIG. 8 is a fragmentary sectional side view of the preferred embodiment, illustrating that the latch is in the first position to engage another selected groove.

When it is desired to change the position of the upper frame 4 as shown in FIG. 4 to an inclining position as shown in FIG. 8, the cam 79 is moved from the stopping position to the releasing position by virtue of the sliding movement of the operating lever 78 so as to permit disengagement between the front abutment face 792 of the cam 79 and the rear abutment face 772 of the cam follower 77. Under this condition, the cam follower 77 is moved rearward away from the latch 72 by virtue of urging action of the compression spring 74. The latch 72 is not moved reaward immediately away from the latch engaging member 34, since the front engaging end 721 of the latch plate 720 cannot disengage the engaging groove 343 due to the body weight of the seated person. The seated person needs to shake slightly in order to lessen the body weight acting on the latch plate 720 so as to release the engaging end 721 of the latch plate 720 from the engaging groove 343 and so as to permit rearward movement of the latch plate 720 to the second position by virtue of the urging action of the urging member 73. A rearward tilting action of the upper frame 4 relative to the lower frame 3 is subsequently conducted, and the cam 79 is moved concurrently from the releasing position to the stopping position by virtue of sliding movement of the operating lever 78 to result in insertion of the front engaging end 721 of the latch plate 72 into a desired one of the engaging grooves 345 in the latch engaging member 34, as best shown in FIG. 8.

The latch 72, the cam follower 77, the urging member 73, the compression spring 74, and the retaining box 71 can be assembled together as a module. The module is subsequently secured to the seat-mounting plate 41 of the upper frame 4 through the rivets 71. As such, assembly or disassembly of the module is relatively convenient.

By virtue of the inclination adjusting device 7 of the chair according to the present invention, the aforesaid drawbacks associated with the prior art can be eliminated.

With this invention thus explained, it is apparent that numerous modifications and variations can be made without departing from the scope and spirit of this invention. It is therefore intended that the invention be limited only as indicated in the appended claims.

I claim:

1. A chair comprising:

a leg unit;

a lower frame having opposite front and rear ends, a base plate secured to said leg unit, spaced-apart side plates extending between said front and rear ends in a longitudinal direction, and a latch engaging member that extends upwardly from said base plate and that is formed with a plurality of spaced apart engaging grooves aligned in a first transverse direction relative said longitudinal direction and said base plate;

a first pivot extending in a second transverse direction relative to said first transverse direction and said longitudinal direction;

an upper frame including a seat-mounting plate disposed above said lower frame, and two side plates that extend downwardly and respectively from two opposite sides of said seat-mounting plate and that are respectively pivoted to said side plates of said lower frame through said first pivot as to permit pivotal action of said upper frame relative to said lower frame;

an urging mechanism connected to said seat-mounting plate of said upper frame and said front end of said lower frame so as to resiliently hold said seat-mounting plate in position; and an inclination adjusting device including a latch mounted slidably on said seat-mounting plate of said upper frame, disposed rearwardly of said latch engaging member, and movable in said longitudinal direction between a first position, in which said latch extends into and engages a selected one of said engaging grooves in said latch engaging member, and a second position, in which said latch disengages said selected one of said engaging grooves in said latch engaging member, and an urging member for urging said latch so as to restore said latch from said first position to said second position;

said inclination adjusting device includes a retaining box that is fixed to said seat-supporting plate, that is disposed rearwardly of said latch engaging member, and that is formed with a pair of guiding grooves extending in said longitudinal direction, a front receiving chamber that is disposed above and that is in spatial communication with said guiding grooves, and a rear receiving chamber that is disposed rearwardly of and that is in spatial communication with said front receiving chamber, and that extends in said second transverse direction, said latch including a latch plate engaging slidably said guiding grooves, and an abutment plate projecting upwardly from said latch plate in said first transverse direction into said front receiving chamber, said urging member being disposed within said front receiving chamber in such a manner as to urge constantly said abutment plate of said latch for restoring said latch to return from said first position to said second position.

2. The chair as defined in claim 1, wherein said inclination adjusting device further includes a cam mechanism having a cam disposed movably within said rear receiving chamber and formed with a first inclined face defining a first cam face, and a cam follower that is disposed within said front receiving chamber, that is formed with a second inclined face defining a second cam face in sliding contact with said first cam face and that is disposed rearwardly of and that is associated with said abutment plate of said latch in such a manner as to simultaneously move therewith, said cam being moveable within said rear receiving chamber between a restricting position and a releasing position in such a manner that movement of said cam from said releasing position to said restricting position results in movement of said latch with said cam follower against urging action of said urging member from said second position to said first position and that movement of said cam from said restricting position to said releasing position results in movement of said latch with said cam follower from said first position to said second position by the virtue of urging action of said urging member.

3. The chair as defined in claim 2, wherein said inclination adjusting device further includes an operating lever extending movably in said second transverse direction through said rear receiving chamber and said side plates of said upper frame, and being movable in said second transverse direction, said cam being mounted securely on said operating lever for co-movement therewith when said operating lever moves in said second transverse direction, said first and second cam faces being inclined relative to said operating lever.

4. The chair as defined in claim 3, wherein said cam is further formed with a front abutment face that is parallel to said operating lever and that extends from said first cam face, said cam follower being further formed with a rear abutment face that is parallel to said operating lever and that extends from said second cam face, said cam being further movable in said second transverse direction from said restricting position to a stopping position, in which said front abutment face of said cam abuts against said rear abutment face of said cam follower, thereby preventing sliding movement of said cam from said stopping position to said releasing position.

5. The chair as defined in claim 4, wherein said cam follower has a front end opposite to said rear abutment face, and is further formed with an engaging tongue projecting downwardly therefrom adjacent to said front end, said inclination adjusting device further including a bottom plate that is secured to said retaining box so as to conceal said guiding grooves, and that is formed with a through-hole to permit extension of said tongue of said cam follower therethrough so as to prevent removal of said cam follower, said latch and said urging member from said front receiving chamber.

6. The chair as defined in claim 5, further comprising second and third pivots, and a backrest-supporting frame disposed rearwardly of said lower frame, said backrest-supporting frame including two side plates extending in said longitudinal direction and pivoted respectively to said side plates of said lower frame through said second pivot and to said side plates of said upper frame through said third pivot such that said second and third pivots are disposed rearwardly of and are parallel to said first pivot.

7. The chair as defined in claim 6, further comprising a compression spring that is mounted within said front receiving chamber in said retaining box between said latch and said cam follower, and that has two opposite ends respectively urging said abutment plate of said latch and said cam follower.

* * * * *